US007591121B2

(12) United States Patent
Lin

(10) Patent No.: US 7,591,121 B2
(45) Date of Patent: Sep. 22, 2009

(54) FLUID FILLING SYSTEM

(75) Inventor: Mong-Tung Lin, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 193 days.

(21) Appl. No.: 11/411,586

(22) Filed: Apr. 26, 2006

(65) Prior Publication Data

US 2006/0254668 A1 Nov. 16, 2006

(30) Foreign Application Priority Data

May 13, 2005 (CN) ..... 2005 1 0034653

(51) Int. Cl.
*B65B 63/08* (2006.01)
*B65B 31/00* (2006.01)

(52) U.S. Cl. ..... 53/127; 53/79; 53/510

(58) Field of Classification Search ..... 53/432, 53/403, 405, 52, 79, 90, 510, 467, 127
See application file for complete search history.

(56) References Cited

U.S. PATENT DOCUMENTS

| | | | | |
|---|---|---|---|---|
| 3,575,220 | A * | 4/1971 | Davis et al. | 141/130 |
| 3,769,674 | A | 11/1973 | Droughton et al. | |
| 3,893,278 | A * | 7/1975 | Lewis | 53/401 |
| 3,965,649 | A * | 6/1976 | Cassou | 53/127 |
| 4,104,807 | A * | 8/1978 | Braun | 34/92 |
| 4,106,171 | A | 8/1978 | Basiulis | |
| 5,594,183 | A * | 1/1997 | Colin | 73/864.52 |
| 6,104,485 | A * | 8/2000 | Wang et al. | 356/246 |
| 6,164,858 | A * | 12/2000 | Kaufmann | 401/205 |
| 6,613,927 | B1 * | 9/2003 | Kwok | 558/81 |
| 6,619,384 | B2 * | 9/2003 | Moon et al. | 165/104.26 |
| 6,647,625 | B2 | 11/2003 | Wang et al. | |
| 7,213,637 | B2 * | 5/2007 | Lin et al. | 165/104.21 |
| 2006/0000581 | A1 * | 1/2006 | Chen et al. | 165/104.21 |

FOREIGN PATENT DOCUMENTS

| | | |
|---|---|---|
| CN | 2600920 Y | 1/2004 |
| JP | 56-113993 | 9/1981 |
| JP | 7-305977 | 11/1995 |
| JP | 11-51421 | 2/1999 |
| TW | 153725 | 3/1991 |
| TW | 156410 | 4/1991 |

OTHER PUBLICATIONS

Jun Zhuang, Hong Zhang, "Heat Pipe Technology and Engineering Application", Jun. 2000, p. 237-239, Chemical Industry Press, BeiJing, China.

* cited by examiner

*Primary Examiner*—Louis K Huynh
(74) *Attorney, Agent, or Firm*—Clifford O. Chi

(57) ABSTRACT

A fluid filling system for a vacuum container includes a fluid supply system configured for filling fluid into a container to be filled, a vacuum exhaust system configured for vacuumizing the container to a predetermined vacuum pressure, and a refrigeration device configured for freezing the fluid filled in the container. A fluid filling method for a vacuum container is also provided.

18 Claims, 2 Drawing Sheets

FLUID FILLING SYSTEM

TECHNICAL FIELD

The invention relates to fluid filling systems and, more particularly, to a fluid filling system and method for a vacuum container.

BACKGROUND

At present, electronic and electrical components such as central processing units (CPUs) are continuing to be developed to have faster operational speeds and greater functional capabilities. A CPU may be mounted in a limited space within a computer enclosure, and when the CPU operates at high speeds, its temperature may increase greatly. Thus, it is desirable to quickly dissipate the heat generated by the CPU. Similarly, many devices such as internal combustion engines of motor vehicles ordinarily generate much heat, and may generate vast amounts of heat when operating at high capacity. It is desirable to quickly dissipate the heat generated by an engine.

Numerous kinds of heat dissipation systems have been developed for cooling electronic, electrical and mechanical components. For example, heat pipes are commonly used in computer enclosures. A typical heat pipe includes an evaporation section for absorbing heat and a condensation section for dissipating heat. Working fluid is contained in a wick formed on an inner wall of the heat pipe. The working fluid transfers heat from the evaporation section to the condensation section by way of phase change.

In general, the heat pipe is vacuumized at a desired vacuum pressure, e.g., generally between $1.3\times10^{-1}$ and $1.3\times10^{-4}$ Pa (pascal). This helps speed the flow of the working fluid. When the heat pipe is manufactured and vacuumized, the vacuumizing is generally performed after the working fluid is filled into the heat pipe. However, the working fluid is generally comprised of a volatile fluid, for example, methanol, alcohol, acetone, ammonia, heptane, etc. Thus during the vacuumizing process, a certain small amount of working fluid is usually sucked out of the heat pipe together with air. This results in the actual filling volume of the working fluid being less than the preset desired filling volume. The short fall of the actual filling volume may be significant, as detailed below.

The preset filling volume of the working fluid is generally calculated so that the working fluid is accommodated in the wick to an extent whereby the capillary capability of the wick is optimal. If the actual filling volume is less than the preset filling volume, a part of the wick (generally in the evaporation section) is prone to be prematurely dried out. On the contrary, if the actual filling volume is more than the preset filling volume, the wick may be overburdened with working fluid whereby the capillary capability of the wick is limited. In both of these error situations, the thermal efficiency of the heat pipe is decreased.

To attain the exact preset filling volume, one approach used is to simultaneously perform the vacuumizing process and the working fluid filling process. However, this approach requires that the two processes be carefully operated and monitored, and in general a large sophisticated apparatus is required. Even then, it can still be difficult to accurately control the filling volume of the working fluid into the heat pipe.

What is needed, therefore, is a fluid filling system for a vacuum container, wherein the fluid filling system is relatively compact and is able to accurately control the filling of working fluid into a heat pipe to reach a predetermined filling volume.

What is also needed is a fluid filling method for a vacuum container using a fluid filling system having the above-described advantages.

SUMMARY

In accordance with a preferred embodiment, a fluid filling system for a vacuum container includes a fluid supply system configured for filling fluid into a container to be filled, a vacuum exhaust system configured for vacuumizing the container to a predetermined vacuum pressure, and a refrigeration device configured for freezing the fluid filled in the container.

A fluid filling method for a vacuum container includes: filling a fluid into a container; freezing the fluid filled in the container; vacuumizing the filled container to attain a predetermined vacuum pressure therein; and sealing the vacuumized container.

Other advantages and novel features will become more apparent from the following detailed description of embodiments when taken in conjunction with the accompanying drawings.

BRIEF DESCRIPTION OF THE DRAWINGS

The components in the system drawing are not necessarily to scale, the emphasis instead being placed upon clearly illustrating the principles of the present fluid filling system.

DETAILED DESCRIPTION OF THE EMBODIMENTS

Embodiments of the present fluid filling system and method for a vacuum container will now be described in detail below with reference to the drawings.

Figure 1:
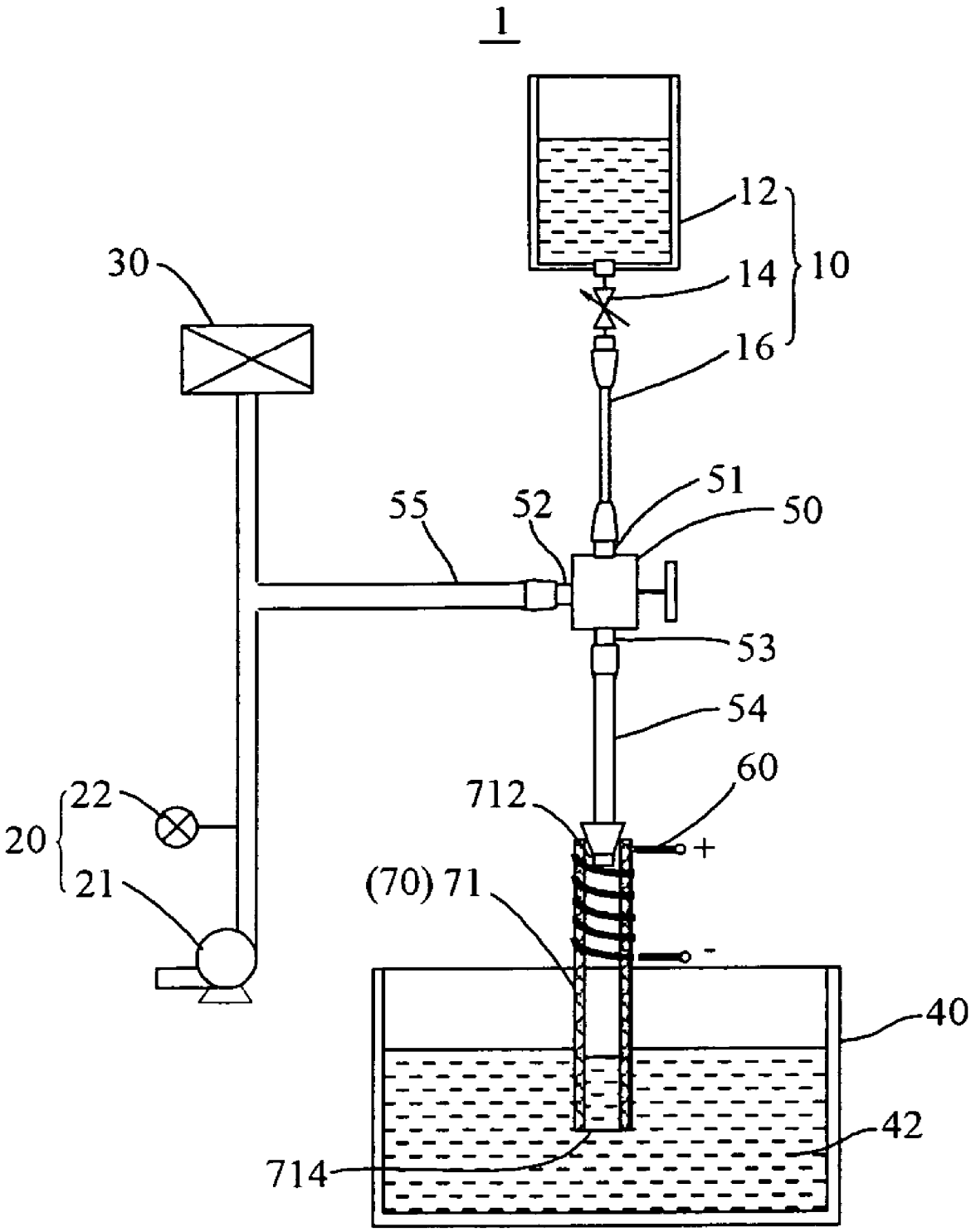
FIG. 1 is a simplified, schematic view of a fluid filling system for a vacuum container in accordance with a preferred embodiment of the present invention.

FIG. 1 illustrates a fluid filling system 1 for a vacuum container in accordance with a preferred embodiment of the present invention. The fluid filling system 1 has a generally H-shaped configuration, and mainly includes a fluid supply system 10, a vacuum exhaust system 20, an inflator 30, a refrigeration device 40, a three-way valve 50, and a heater 60.

The three-way valve 50 generally has three nozzles; i.e., a first nozzle 51, a second nozzle 52, and a third nozzle 53. The fluid supply system 10 is connected with the first nozzle 51. The vacuum exhaust system 20 and the inflator 30 are commonly connected to the second nozzle 52. The third nozzle 53 is adapted to connect with a container 70 to be filled. In the illustrated embodiment, the container 70 is a hollow heat pipe preform 71. The heat pipe preform 71 is generally a hollow pipe with an open end 712 and an opposite sealed end 714. The heat pipe preform 71 has a wick formed on an inner wall thereof A fluid guide pipe 54 can optionally be used to interconnect the third nozzle 53 and the open end 712 of the heat pipe preform 71.

The fluid supply system 10 preferably includes a fluid container 12, a micro-valve 14, and a micro capillary 16 connected in series. The fluid container 12 contains a fluid to be filled in the heat pipe preform 71. The micro-valve 14 is positioned between the fluid container 12 and the micro capillary 16, and is used to control flow of the fluid from the fluid container 12 into the micro capillary 16. The micro capillary 16 is connected with the first nozzle 51. The micro capillary 16 is advantageously a quantitative capillary or a graduated capillary having a micrometer scale.

The quantitative capillary is suitable for use in a quantitative fluid filling process, i.e., where a total fluid volume of the capillary is equal to a predetermined fluid filling volume. This facilitates the performance of the filling process. The graduated capillary is suitable for use in various fluid filling processes requiring different fluid quantities. Micrometer graduations of the graduated capillary are arranged in order from top to bottom like a burette, with an initiation graduation (e.g., a "0" point) being adjacent the micro-valve 14. Advantageously, smallest graduations of the graduated capillary correspond to very small increments of volume, which may for example be 0.1 milliliters or may for example be as little as 0.01 milliliters. The graduated capillary advantageously can have an inner diameter in the range from approximately 0.1 millimeters to approximately 1 millimeter.

The vacuum exhaust system 20 generally includes a vacuum pump 21 and a vacuum gauge 22. The vacuum gauge 22 is advantageously positioned between the vacuum pump 21 and the second nozzle 52, and is configured for measuring and monitoring the pressure of vacuum of the container 70 during the vacuumizing process. The vacuum exhaust system 20 and the inflator 30 are each connected to the second nozzle 52 via a common pipe 55, thereby forming a common gas passage to the container 70.

The inflator 30 is configured for blowing any remaining fluid, generally remaining in the three-way valve 50 and in the fluid guide pipe 54, into the container 70. Thereby, any fluid filling error is decreased. During a vacuumizing process, only the vacuum exhaust system 20 is in communication with the second nozzle 52. During a blowing process, only the inflator 30 is in communication with the second nozzle 52.

The refrigeration device 40 is configured for partially or fully freezing the container 70 so as to freeze the fluid filled therein, thereby preventing the fluid from evaporating and escaping out of the container 70 during the vacuumizing process. The refrigeration device 40 can be in the form of a bath or a loop-cooler. Coolant 42 of the refrigeration device 40 is comprised of a material selected from the group consisting of dry ice, liquid nitrogen, freon™, and refrigerating brine. In the illustrated embodiment, the refrigeration device 40 is in the form of a bath, and the coolant 42 is liquid nitrogen.

The heater 60 is configured for preheating the container 70 in order to remove any liquid or vapor contaminants therefrom prior to filling of the fluid therein. The contaminants may, for e.g., be water or waste such as oil. In general, the contaminants are present by way of being adsorbed on an inner wall of the container 70. For example, when the container 70 is the heat pipe preform 71, contaminants may be present by way of being adsorbed on the wick of the heat pipe preform 71. After preheating, the container 70 is cleaned, thereby ensuring that the subsequent filling process is unimpaired. Thus the heater 60 can be any suitable heater such as an immersion water heater or an electrical heater.

The H-shaped configuration of the fluid filling system 1 is advantageous in that it can reduce the overall size of and/or the overall space occupied by the fluid filling system 1. Furthermore, the fluid guide pipe 54 is connected with the fluid supply system 10 or the vacuum exhaust system 20 or the inflator 30 alternatively via the three-way valve 50. With the H-shaped configuration of the fluid filling system 1, any fluid remaining in the three-way valve 50 and the fluid guide pipe 54 can be fully utilized relatively easily. Therefore, the volume of the fluid filled into the container 70 can be accurately controlled.

Figure 2:
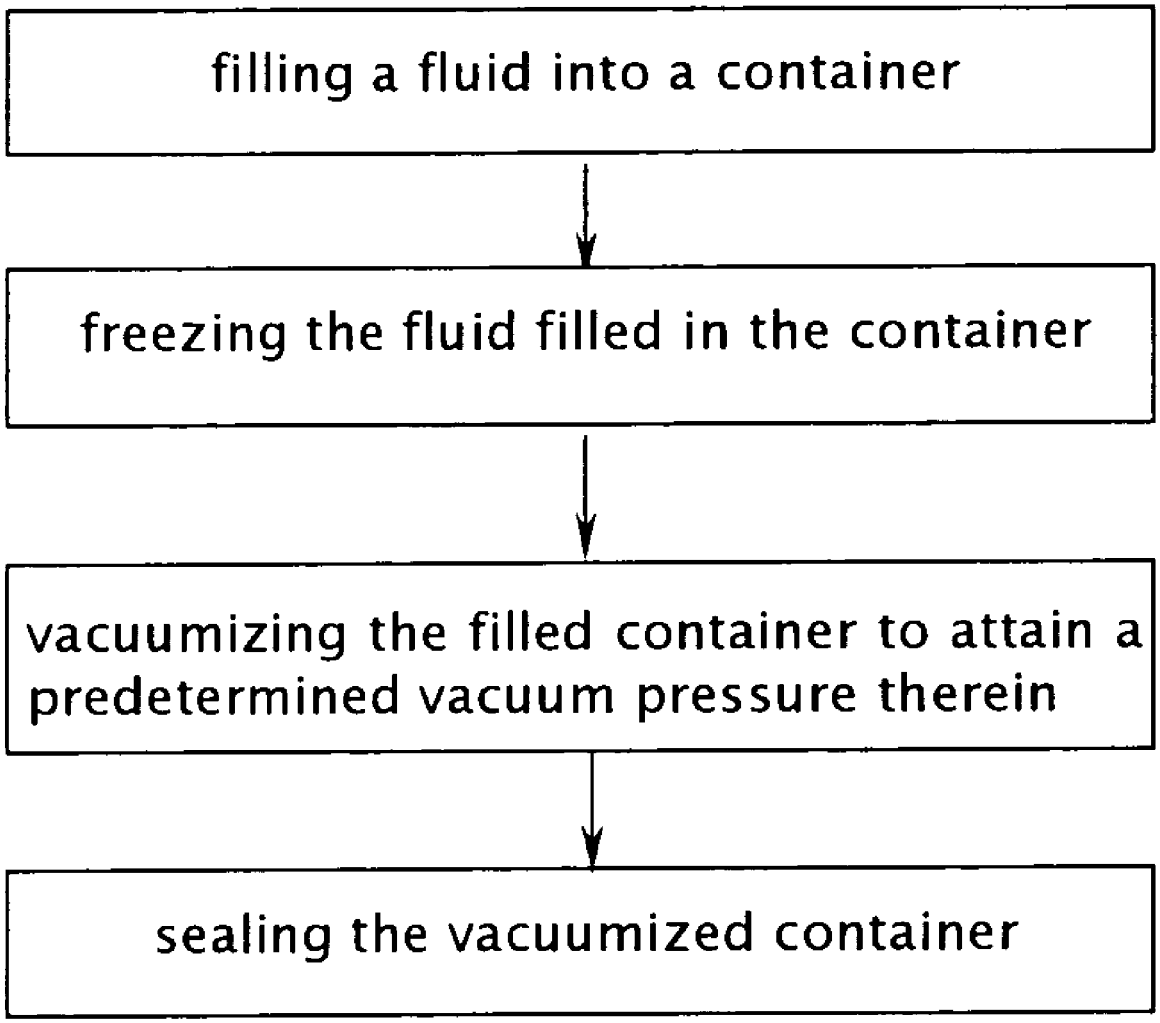
FIG. 2 is a flow chart of a fluid filling method for a vacuum container, in accordance with another preferred embodiment of the present invention.

Referring also to FIG. 2, this shows steps in a preferred fluid filling method for a vacuum container (such as the container 70) using the fluid filling system 1. Briefly, the method includes the steps of: filling a fluid into a container; freezing the fluid filled in the container; vacuumizing the filled container to attain a predetermined vacuum pressure therein; and sealing the vacuumized container.

In filling step, in the illustrated embodiment, the fluid is filled into the container 70 via the fluid supply system 10. The three-way valve 50 is switched and opened to the fluid supply system 10, and the vacuum exhaust system 20 and inflator 30 sides are shut off. The fluid is accurately controlled by the micro capillary 16 and conducted to the container 70 via the three-way valve 50 and the fluid guide pipe 54.

In addition, preferably, a step of preheating the container 70 is performed prior to filling the fluid into the container 70, so as to remove liquid or vapor contaminants therefrom (see above). The preheating step is particularly beneficial when the container 70 is the heat pipe preform 71, because the wick of the heat pipe preform 71 readily adsorbs liquid or vapor contaminants such as water, waste, oil, and so on.

After the filling step, some fluid may remain in the three-way valve 50 and the fluid guide pipe 54. Thus, a step of blowing gas into the container 70 is preferably conducted prior to the freezing step. At this time, the three-way valve 50 is switched and opened only to the inflator 30 while keeping the vacuum exhaust system 20 side shut off. The inflator 30 blows any fluid remaining in the three-way valve 50 and the fluid guide pipe 54 into the container 70. Thereby, the accuracy of the fluid filling can be increased. At this stage, in the case that the container 70 is the heat pipe preform 71, the fluid is generally adsorbed inside the wick of the heat pipe preform 71.

In the freezing step, first, the three-way valve 50 is fully closed. Then the fluid filled in the container 70 is frozen by the coolant 42. In the illustrated embodiment, the sealed end 714 of the heat pipe preform 71 is submerged in the coolant 42. This effectuates freezing of the fluid by utilizing the typically excellent heat conductivity of the heat pipe preform 71. Because the unfrozen fluid is generally adsorbed inside the wick of the heat pipe preform 71, after the freezing step, the fluid is generally solidified inside the wick.

In the vacuumizing step, the three-way valve 50 is switched and opened only to the vacuum exhaust system 20 while keeping the inflator 30 side shut off The vacuumizing is performed by the vacuum pump 21 until the vacuum gauge 22 attains a desired vacuum reading. During the vacuumizing, since the fluid is initially frozen in the container 70, or frozen in the wick of the heat pipe preform 71, little if any evaporation of the frozen fluid occurs. That is, during the vacuumizing process, fluid loss is minimized. Thereby, a high accuracy of the fluid filling can be maintained.

After the vacuumizing step, a step of sealing the container 70 (e.g., the open end 712 of the heat pipe preform 71) is preferably performed immediately under high vacuum pressure. Thereby, a low-pressure container filled with the fluid is obtained. For example, a low-pressure heat pipe filled with the fluid is obtained. It is noted that the heat pipe may for example be in a form of a tubular heat pipe or a plate-type heat pipe. The tubular heat pipe may for example be straight, U-shaped, loop-shaped, helical, and so on.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A fluid filling system for a vacuum container, comprising:

a fluid supply system configured for filling fluid into a container to be filled, with the fluid supply system being configured for accurately filling a volume of the fluid into the container;

a vacuum exhaust system configured for vacuumizing the container to a predetermined vacuum pressure;

a refrigeration device configured for freezing the fluid filled in the container;

a three-way valve having a first, second, and third nozzles, the first nozzle being connected to the fluid supply system, the second nozzle being connected to the vacuum exhaust system, and the third nozzle being connected to the container; and an inflator being connected to the second nozzle and configured for blowing any fluid not yet in the container and remaining in the three-way valve into the container.

2. The fluid filling system of claim 1, further comprising a heater configured for preheating the container to remove any liquid or vapor contaminants therefrom.

3. The fluid filling system of claim 1, wherein the fluid supply system comprises a fluid container, a micro-valve, and a micro capillary connected in series.

4. The fluid filling system of claim 3, wherein the micro capillary is one of a quantitative capillary and a graduated capillary.

5. The fluid filling system of claim 4, wherein a smallest graduation of the graduated capillary corresponds to an increment in volume of the fluid of 0.01 milliliters.

6. The fluid filling system of claim 4, wherein the graduated capillary has an inner diameter in the range from approximately 0.1 millimeters to approximately 1 millimeter.

7. The fluid filling system of claim 3, wherein the micro capillary is connected to the first nozzle.

8. The fluid filling system of claim 1, wherein the vacuum exhaust system compnses a vacuum pump, and a vacuum gauge configured to be positioned between the vacuum pump and the container.

9. The fluid filling system of claim 1, wherein the refrigeration device contains a coolant configured for freezing the fluid filled in the container.

10. The fluid filling system of claim 9, wherein the coolant is comprised of a material selected from the group consisting of dry ice, liquid nitrogen, freon™, and refrigerating brine.

11. The fluid filling system of claim 1, further comprising a fluid guide pipe, the fluid guide pipe being connected to one of the fluid supply system and the vacuum exhaust system with the three-way valve.

12. The fluid filling system of claim 11, further comprising a common pipe, both the inflator and the vacuum exhaust system being connected to the second nozzle with the common pipe.

13. A fluid filling system for a vacuum container, the fluid filling system comprising:

a fluid supply system configured for filling fluid into a container to be filled, with the fluid supply system being configured for accurately filling a volume of the fluid into the container;

a vacuum exhaust system configured for vacuumizing the container to a predetermined vacuum pressure;

an inflator configured for blowing fluid into the container, the inflator and the vacuum exhaust system being communicated to the container via a common pipe;

a refrigeration device configured for freezing the fluid filled in the container; and a three-way valve, the three-way valve having a first, second, and third nozzles, the first nozzle being connected to the fluid supply system, the second nozzle being connected to the common pipe, and the third nozzle being connected to the container.

14. The fluid filling system of claim 13, further comprising a heater configured for preheating the container to remove any liquid or vapor contaminants therefrom.

15. The fluid filling system of claim 13, wherein the fluid supply system comprises a fluid container, a micro-valve, and a micro capillary connected in series.

16. The fluid filling system of claim 15, wherein the micro capillary is one of a quantitative capillary and a graduated capillary.

17. The fluid filling system of claim 13, wherein the vacuum exhaust system compnses a vacuum pump, and a vacuum gauge configured to be positioned between the vacuum pump and the container.

18. The fluid filling system of claim 13, further comprising a fluid guide pipe, the fluid guide pipe being connected to one of the fluid supply system and the common pipe with the three-way valve.

* * * * *

UNITED STATES PATENT AND TRADEMARK OFFICE

CERTIFICATE OF CORRECTION

PATENT NO. : 7,591,121 B2
APPLICATION NO. : 11/411586
DATED : September 22, 2009
INVENTOR(S) : Mong-Tung Lin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 342 days.

Signed and Sealed this

Fourteenth Day of December, 2010

David J. Kappos

David J. Kappos
*Director of the United States Patent and Trademark Office*